US006811827B2

(12) United States Patent
Brisberger et al.

(10) Patent No.: US 6,811,827 B2
(45) Date of Patent: Nov. 2, 2004

(54) METHOD AND INSTALLATION FOR HOT DIP COATING METAL STRIPS

(75) Inventors: Rolf Brisberger, Issum (DE); Peter de Kock, Oberhausen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/220,389

(22) PCT Filed: Feb. 24, 2001

(86) PCT No.: PCT/EP01/02104

§ 371 (c)(1),
(2), (4) Date: Dec. 9, 2002

(87) PCT Pub. No.: WO01/64970

PCT Pub. Date: Sep. 7, 2001

(65) Prior Publication Data

US 2003/0145914 A1 Aug. 7, 2003

(30) Foreign Application Priority Data

Mar. 1, 2000 (DE) ..... 100 09 823

(51) Int. Cl.[7] ..... B05D 1/18

(52) U.S. Cl. ..... 427/431; 427/329; 427/434.2; 427/436; 118/419; 118/66; 118/68

(58) Field of Search ..... 427/431, 329, 427/319, 328, 436, 443.2, 434.2, 433; 118/419, 66, 68, 72, 73, 65

(56) References Cited

U.S. PATENT DOCUMENTS 4,143,184 A * 3/1979 Paulus et al. ..... 148/272
4,408,561 A 10/1983 Yokoyama et al.
6,096,137 A * 8/2000 Mabuchi et al. ..... 134/3
6,266,983 B1 * 7/2001 Takada et al. ..... 72/11.1

FOREIGN PATENT DOCUMENTS

| | | | |
|---|---|---|---|
| EP | 0506000 | | 3/1992 |
| EP | 0613736 | | 9/1994 |
| EP | 0863222 | | 9/1998 |
| GB | 0954367 | | 4/1964 |
| GB | 1004704 | * | 9/1965 |

OTHER PUBLICATIONS

Patent Abstract of Japan No. 55–006436, Jan. 1980.
Patent Abstract of Japan No. 57–063673, Apr. 1982.
Patent Abstract of Japan No. 07–113155, May 1995.

* cited by examiner

*Primary Examiner*—Bret Chen
(74) *Attorney, Agent, or Firm*—Sidley Austin Brown & Wood, LLP

(57) ABSTRACT

In a process of hot dip coating of metal strips, in particular, of a hot rolled steel strip, in which the metal strip is transformed into a continuous strip in an unwinding station with an adjoining welding machine, and then the continuous strip is subjected to a downstream modifying process including primary and secondary prickling and, in the final treatment step; in the hot dip coating section, guiding the continuous strip through a melt bath, a variable coating process with reduced costs becomes possible when the continuous strip, in a first treatment step, is directly transported into a pickling installation. In a suitable installation for effecting the process, the primary pickling installation is located in the entry section which is separated from the hot dip coating section by an entry accumulator.

5 Claims, 1 Drawing Sheet

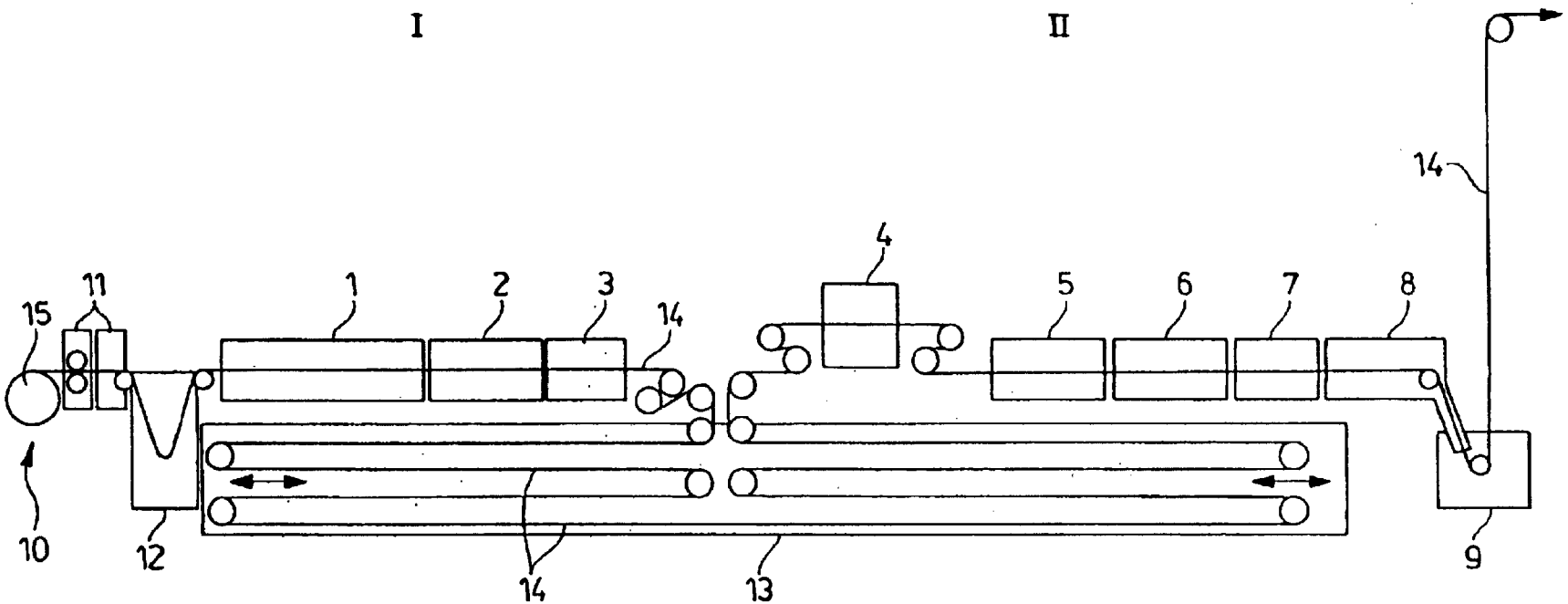
I
II
1
2
3
4
5
6
7
8
9
10
11
12
13
14
14
14
15

METHOD AND INSTALLATION FOR HOT DIP COATING METAL STRIPS

The present invention relates to a method of and an installation for hot dip coating of metal strips, in particular, of a hot rolled steel strip, in which the metal strip is transformed into a continuous strip in an unwinding station with an adjoining welding machine, and then the continuous strip is subjected to a downstream modifying process including primary and secondary prickling and, in the final treatment step, in the hot dip coating section, guiding the continuous strip through a melt bath.

For hot dip coating of a hot strip but also of an as-rolled and/or cold annealed strip, it is known to transform a strip coil into a continuous strip or make available a continuous strip by welding respective coil ends with beginnings of the following coils in an unwinding station that includes, e.g., a twin or turret reel and an adjoining the reel, welding machine. The unwinding station is adjoined by a looping accumulator in vertical or horizontal implementation which insures effecting a following continuous treatment process. The oxidized strip, which provides for a non-insignificant portion of dust, is stored in the looping accumulator. Therefore, the accumulator should be encapsulated. After leaving the looping accumulator, the strip, in the first operational step, is pulled through a stretcher-and-roller leveller to achieve a desired flatness of the strip. During this process, breaking and partial flaking-off of the scale layer take place. This requires that the fallen-off particles be aspirated and filtered. In addition, the roller supports of the stretcher-and-roller leveller should be protected against the finest scale particles which is very expensive and, to this end, the stretcher-and-roller leveller is entirely encapsulated.

The strip, which runs out of the stretcher-and-roller leveller, in known plants, is transported in a pickling station in which the scale layer and reaction products are removed from the strip surface. In a further operational step, the strip runs through an adjoining rinsing station in order to rinse off the residues of pickling products from the strip surface before the strip is introduced into the drying station to be dried there. A secondary pickling installation with a following rinsing installation can adjoin the primary pickling installation with its rinsing installation and be arranged in front of the drying installation. Finally, from the drying station, in a following operational step, the strip is introduced into a furnace with a protective gas atmosphere where the strip is brought to a coating temperature before it, in the last operational strip, is guided through a melt bath to provide the surface of the strip with a metallic coating.

The object of the invention is to provide a method and an installation of the type described above which would permit to conduct a variable coating process with reduced costs.

According to the invention, this object is achieved by a method that includes transporting a continuous strip, in a first treatment step, directly into a pickling installation. An installation for effecting the process contemplates, according to the invention, providing the primary pickling installation in the entry section which is separated from hot dip coating section by an entry accumulator.

Because the metal strip, according to the invention, after leaving the welding machine, runs in directly into the pickling installation, numerous advantages are simultaneously obtained. Thus, it is insured that in the following sections of the installation, the rinsing station and the drying station, which follow the pickling installation, a scale-free metal strip is treated, which makes encapsulation of the entry accumulator and of the stretcher-and-roller leveller unnecessary. The stretcher-and-roller leveller can be simply formed because an extensive scale suction is eliminated. Furthermore, separation or decoupling of the primary pickling installation from the hot dip coating process is achieved. Thus, advantageously, the first entry accumulator is arranged between the welding machine and the immediately following it, the primary pickling installation, and the second strip accumulator is arranged in front of the hot dip coating section and behind the primary pickling installation. A short stoppage in the pickling station does not require, as in the conventional processes, stoppage of the hot dip coating process, which results in production of scrap. And vice versa, a short stoppage of the hot dip coating process does not result in overpickling of the strip in the primary pickling installation because the following it, looping accumulator has an adequate receiving capacity. In addition, the adjoining the pickling installation, accumulator is kept scale-free.

For a combined operation with a hot strip and a cold strip in an as-ready or annealed condition, the advantage consists in that upon conversion to an operation with a cold strip, no preliminary rinsing of the accumulator, rolls, and the stretcher-and-roller leveller is necessary. Thereby, the waste time is minimized, and the quality of the strip is improved.

In the installation, the entry section of which advantageously includes a primary pickling installation, a rinsing station, and following it, drier, and the hot dip coating section of which includes following each other, stretcher leveller, secondary pickling installation, rinsing installation, drier, and a furnace located upstream of the melt bath, the secondary pickling installation, which has small dimensions, serves for activating of the steel strip surface, which insures the quality of the subsequent coating.

Further advantages and features of the present invention follow from the claims and the following description of an embodiment of the invention shown in the drawing.

A single FIGURE of the drawing shows a schematic view of a plant for effecting a modified process of hot galvanizing of a metal strip by using a process of hot dip coating. The plant includes an entry section I and a hot dip coating section II, where the two sections are disconnected from each other, so that the entry section I operates intermittently and the hot dip coating section operates continuously. The entry section I includes a primary pickling installation 1, a rinsing installation 2, and a drier 3. The hot dip coating section II includes following each other in a row a stretcher leveller or stretcher-and-roller leveller 4, a secondary pickling station 5, a rinsing installation 6, a drier 7, a furnace 8 with a protective gas atmosphere in vertical or horizontal implementation, and, finally, a melt bath 9 for hot dip coating.

Upstream of the entry section I, there are provided an unwinding station 10 (twin or turret reel) with an adjoining welding machine 11, and a looping pit 12. Between the entry section I, namely, after its drier 3, and the hot dip section II, there is provided, in this embodiment, a horizontal strip or entry accumulator 13.

A to-be-coated metal strip 14 is loaded, in form of a strip coil 15, into the unwinding station 10 of the installation shown in the drawing, and is displaced in a direction shown with arrows. In the welding machine 11, the strip end of a first coil is welded to the beginning of the strip of a following coil, so that the metal strip 14 is displaced through the installation as a continuous strip. With the use of the looping pit 12 having a certain accumulator capacity, the metal strip 14 is displaced from the welding machine 11 directly into the main pickling installation 1 and the following installation sections 2 and 3 of the entry section I, so that an already scale-free strip runs into entry accumulator 13 with main accumulator capacity, and the following sections of the hot dip coating section II. Because neither in the entry accumulator 13 nor in the adjoining it stretcher-and-roller leveller 4, the scale can be produced, it is not any more necessary to encapsulate these sections and to provide these sections with additional suction and filtering devices. Finally, the disconnected installation sections I and II make a short stoppage, which is necessary because of the operational conditions, harmless because the stoppage takes place either in the entry section I or in the hot dip coating section II.

What is claimed is:

1. A method of hot dip coating of a metal strip comprising the steps of:

unwinding metal strips from strip coils and forming an endless strip by welding a strip end of a first coil to a strip beginning of a following coil;

advancing the endless strip into a first entry accumulator;

advancing the endless strip from the first entry accumulator one of continuously and intermittently directly into a primary pickling installation of an entry section for descaling the strip;

advancing the strip from the entry section into a secondary entry accumulator;

advancing the strip from the secondary entry section of one continuously and intermittently into a hot dip coating section including a secondary pickling installation for additionally treating the strip and a melt bath located downstream of the secondary pickling installation for coating the strip.

2. A method according to claim 1, further comprising the steps of leveling the strip after it leaves the second entry accumulator and before it enters the secondary pickling installation, and rinsing and subsequently drying the strip after it leaves the secondary pickling installation but before it enters the melt bath.

3. An installation for hot dip coating of metal strips, comprising:

an winding station for unwinding metal strips from strip coils;

a welding machine located downstream of the unwinding station for forming an endless strip by welding a strip end of a first coil to a strip beginning of a following coil;

a first entry accumulator located downstream of the welding machine;

an entry section including a primary pickling installation located immediately downstream of the first entry accumulator;

a second entry accumulator located downstream of the entry section;

a hot dip coating section located downstream of the second entry accumulator and including a secondary pickling installation located downstream of the second entry accumulator, and a melt bath for hot dip coating of the strip and arranged downstream of the secondary pickling installation.

4. A hot dip coating installation according to claim 3, wherein the entry section further includes a rinsing installation located downstream of the primary pickling installation, and a drier located downstream of the rinsing installation.

5. A hot dip coating installation according to claim 3, wherein the hot dip coating section further includes a stretcher-and-roller leveler located downstream of the second entry accumulator and upstream of the secondary pickling installation, a further rinsing installation located downstream of the secondary pickling installation and upstream of the melt bath, and a further drier located between the further rinsing installation and the melt bath.

* * * * *